US009857117B2

(12) United States Patent
Kim

(10) Patent No.: US 9,857,117 B2
(45) Date of Patent: Jan. 2, 2018

(54) ICE MAKER

(71) Applicant: DAEYEONG E&B CO., LTD., Gyeonggi-do (KR)

(72) Inventor: Doo-Ha Kim, Incheon (KR)

(73) Assignee: Daeyeong E&B Co., Ltd (KR)

( * ) Notice: Subject to any disclaimer, the term of this patent is extended or adjusted under 35 U.S.C. 154(b) by 217 days.

(21) Appl. No.: 14/608,968

(22) Filed: Jan. 29, 2015

(65) Prior Publication Data

US 2016/0138846 A1 May 19, 2016

(30) Foreign Application Priority Data

Nov. 19, 2014 (KR) ..... 10-2014-0161909

(51) Int. Cl.
*F25C 5/16* (2006.01)
*F25C 5/18* (2006.01)
*F25D 21/14* (2006.01)

(52) U.S. Cl.
CPC ..... *F25C 5/182* (2013.01); *F25D 21/14* (2013.01); *F25C 2500/06* (2013.01); *F25D 2321/146* (2013.01); *F25D 2400/22* (2013.01)

(58) Field of Classification Search
CPC ..... F25D 2321/146; F25C 2500/06
See application file for complete search history.

(56) References Cited

U.S. PATENT DOCUMENTS 2,582,031 A * 1/1952 Harbison ..... E03D 1/01 137/247.33
4,843,835 A * 7/1989 Goetz ..... F25D 21/14 62/285
5,245,841 A * 9/1993 Paul ..... F25C 1/12 312/257.1
2005/0138954 A1* 6/2005 Kim ..... F25D 17/065 62/419
2005/0210884 A1* 9/2005 Tuskiewicz ..... A47F 3/0408 62/3.6
2008/0264090 A1* 10/2008 Sowa ..... F25C 5/182 62/344

FOREIGN PATENT DOCUMENTS

JP 2001-289541 10/2001
JP 2004-176971 6/2004

OTHER PUBLICATIONS

Korean Office Action dated May 11, 2015 issued in counterpart application No. 10-2014-0161909.

* cited by examiner

*Primary Examiner* — Christopher R Zerphey
(74) *Attorney, Agent, or Firm* — The Farrell Law Firm, P.C.

(57) ABSTRACT

An ice maker including piping for water drainage therein is provided. The ice maker includes a cabinet body, an ice storage portion provided in the cabinet body and separable from the cabinet body, a first coupling portion disposed on a lower surface of the ice storage portion and having a first coupling hole, a drain portion provided downwardly of the cabinet body within the cabinet body and including a drainage passage connected to an external drainage hole, and an overflow socket inserted into the first coupling hole and connected to the drainage passage to connect the ice storage portion to the drain portion, and configuring a path allowing water received by the ice storage portion to be discharged to the drainage passage, thereby providing an ice maker having easy separation and coupling.

8 Claims, 14 Drawing Sheets

ICE MAKER

PRIORITY

This application claims priority to and benefit under 35 U.S.C. §119 of Korean Patent Application No. 10-2014-0161909, filed on Nov. 19, 2014, with the Korean Intellectual Property Office, the disclosure of which is incorporated herein by reference.

BACKGROUND

The present disclosure relates to an ice maker, and more particularly, to an ice maker including piping for water drainage therein.

Among ice makers, a self-contained type ice maker is generally installed below a counter or a sink in built-in manner.

Such a self-contained type ice maker includes an ice storage portion therein and is configured to allow ice stored in the ice storage portion to be extracted therefrom through the opening of a door provided in the front surface thereof.

On the other hand, when such built-in type ice makers are repaired or cleaned, negative attributes in which the separation of components thereof is not easy due to relatively cramped space therein may be present.

In particular, ice makers commonly include a drainage device to allow water generated in an ice storage portion and water overflowing from a water tank to be discharged therethrough. Since a drainage hole of such a drainage device is generally disposed in the rear of a product, a pipe of the drainage device is provided in a rear portion of the product.

In the case of ice makers having such a structure, when the ice storage portion is separated for the sake of maintenance and cleaning of the product, difficulties in separating the pipe of the drainage device from the ice storage portion and the water tank may be present.

In order to solve such a problem, in ice makers according to the related art as well as in U.S. Pat. No. 5,245,841, structures are provided in which a pipe of a drainage device is connected to an ice storage portion and a water tank in a forward portion of a product, such that the separation of the pipe by a user may be facilitated at the front of the product.

However, in such ice makers according to the related art, since a pipe is extended from a drainage hole located in the rear of a product to a front portion of the product, a length of the pipe is relatively increased. In the case that such a pipe is not appropriately disposed, water may not be entirely discharged and may remain therein for an extended period of time, thereby causing the interior of the pipe to be contaminated.

In a case in which the interior of a pipe is contaminated, a sanitation problem may occur in which ice in the ice storage may also be contaminated.

In addition, since such a pipe has a relatively long length, pipe interior cleaning may not be easy.

Furthermore, an additional component such as a clamp or the like for the connection of a pipe to an ice storage portion and a water tank may be required, and defects may occur in such an additional component at the time of performing coupling and separation of components and such a component may also be deformed due to use thereof for a long period of time, thus causing loss of functionality.

SUMMARY

Some embodiments of the present disclosure may provide an ice maker of which components may be easily separated from and coupled to each other.

According to an aspect of the present disclosure, an ice maker may include: a cabinet body; an ice storage portion provided in the cabinet body and separable from the cabinet body; a first coupling portion disposed on a lower surface of the ice storage portion and having a first coupling hole; a drain portion provided downwardly of the cabinet body within the cabinet body and including a drainage passage connected to an external drainage hole; and an overflow socket inserted into the first coupling hole and connected to the drainage passage to connect the ice storage portion to the drain portion, and configuring a path allowing water received by the ice storage portion to be discharged to the drainage passage.

The ice maker may further include a water tank disposed upwardly of the ice storage portion and storing ice making water therein; and an overflow pipe provided in the water tank. The overflow pipe may be connected to the overflow socket.

The overflow socket may include a connection hole formed in an upper end portion of the overflow socket, the connection hole being provided such that an end portion of the overflow pipe is inserted therethrough, and a gap formation protrusion formed along an internal circumferential surface of the connection hole to protrude inwardly from the internal circumferential surface of the connection hole to form a drainage spacing between an internal passage and the overflow pipe.

The first coupling portion may have a cylindrical shape protruding downwardly from the ice storage portion and may include a protrusion portion protruding from an internal wall surface forming the first coupling hole, and the overflow socket may include a stop protrusion provided on an outer side surface of the overflow socket and caught by the protrusion portion, and may be configured so that the stop protrusion is caught by the protrusion portion or separated from the protrusion portion via rotation of the overflow socket.

When the overflow socket is inserted into the first coupling hole to be coupled thereto, a level of an upper end of the overflow socket may be equal to or lower than a level of an internal bottom surface of the ice storage portion.

The ice maker may further include a water tank disposed upwardly of the ice storage portion and storing ice making water; a second coupling portion disposed on a lower surface of the ice storage portion and including a second coupling hole, and a drain socket inserted into the second coupling hole and coupled to the drainage passage to connect the ice storage portion and the drain portion to each other and configuring a path through which water stored in the water tank is discharged to the drainage passage.

The second coupling portion may have a cylindrical shape protruding downwardly from the ice storage portion and may include a protrusion plate protruding from an internal wall surface forming the second coupling hole, and the drain socket may include a hook portion provided on an outer side surface of the drain socket and coupled to the protrusion plate and may be configured so that the protrusion plate is coupled to or separated from the hook portion via rotation of the drain socket.

The drain socket may include a hose connection portion protruding upwardly from a bottom surface of the ice storage portion, and a groove formed by cutting a portion of an upper end of the hose connection portion in a vertical direction.

The drainage passage may include a first drainage passage connected to the overflow socket; a second drainage passage connected to the drain socket; and a connection passage connected to the first drainage passage and the second drainage passage and having a distal end connected to an external drainage hole.

The drain portion may include an overflow connection portion provided in an upper end of the first drainage passage and coupled to a lower end portion of the overflow socket, and a drain connection portion provided in an upper end of the second drainage passage and coupled to a lower end portion of the drain socket.

The drain portion may further include a drain valve opening and closing the second drainage passage.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
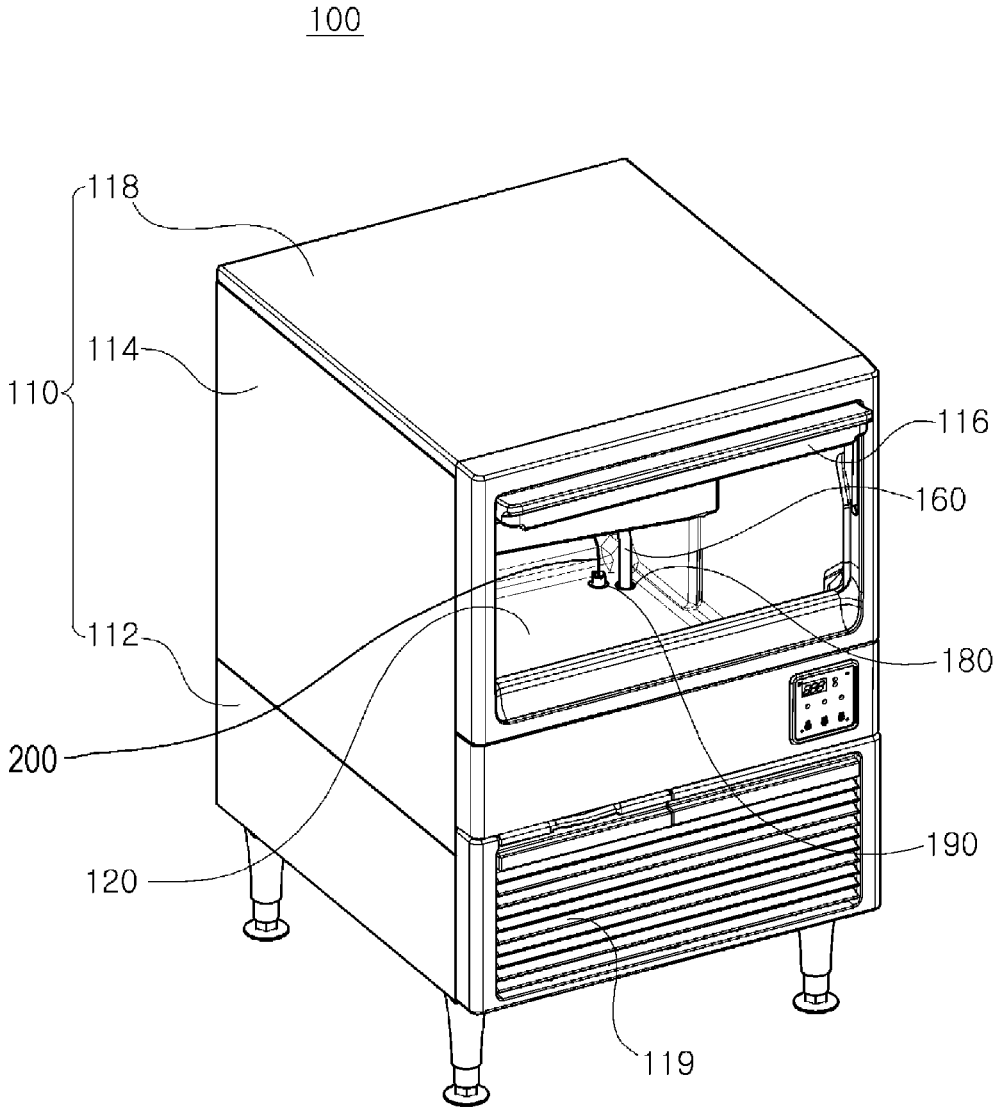
FIG. 1 is a perspective view of an ice maker according to an exemplary embodiment of the present disclosure.
Figure 2:
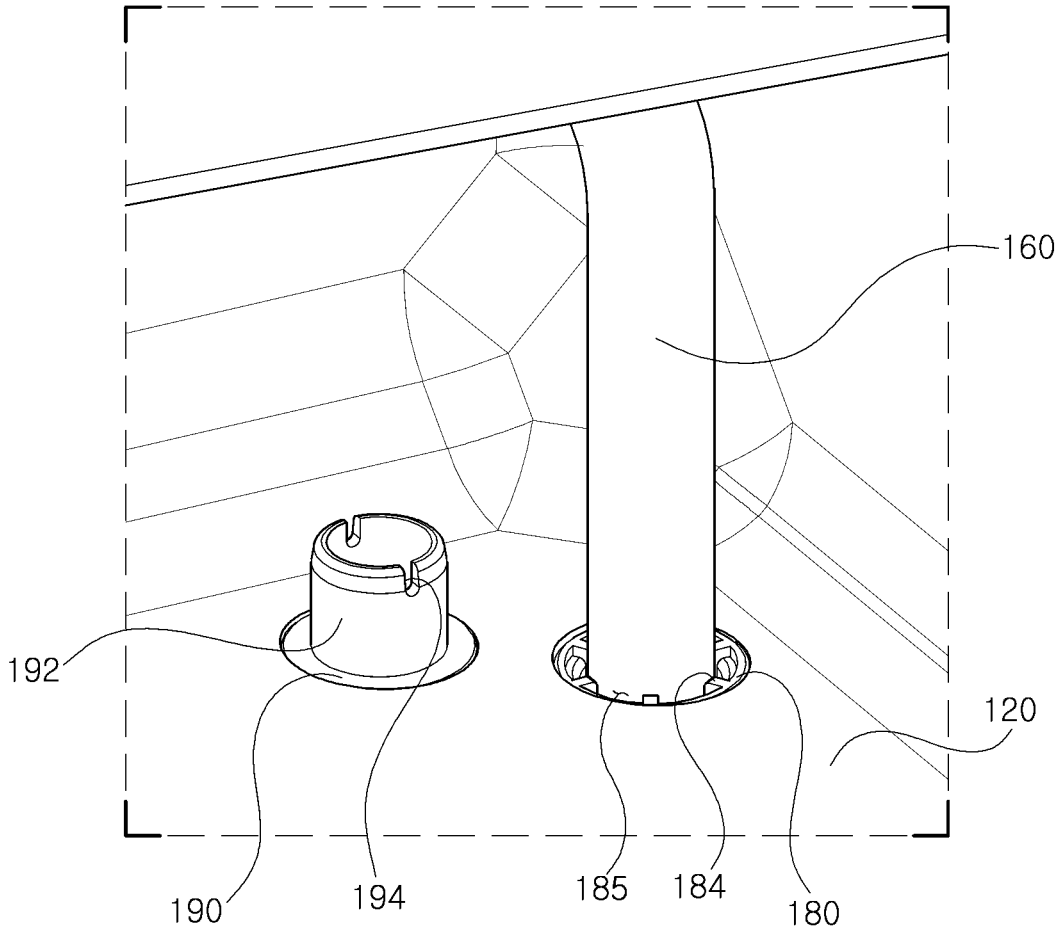
FIG. 2 is a perspective view illustrating a state in which an overflow socket and a drain socket included in the ice maker of FIG. 1 are coupled to each other.

Hereinafter, exemplary embodiments of the present disclosure will be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

First, with reference to FIGS. 1 to 11, an ice maker according to an exemplary embodiment of the present disclosure will be described.

As illustrated in FIGS. 1 to 11, an ice maker 100 according to an exemplary embodiment of the present disclosure may include a cabinet body 110, an ice storage portion 120, a first coupling portion 130, a second coupling portion 140, a water tank 150, an overflow pipe 160, a drain portion 170, an overflow socket 180, and a drain socket 190.

The cabinet body 110 may form an outer casing of the ice maker 100 according to an exemplary embodiment of the present disclosure. In addition, in the ice maker 100 according to an exemplary embodiment of the present disclosure including the ice storage portion 120, the water tank 150, and the drain portion 170 to be described below, the cabinet body 110 may contain an internal space in which various electric-field components may be installed.

In the exemplary embodiment of the present disclosure, an operating door 116 may be provided on a front surface of the cabinet body 110 to allow ice stored in the ice storage portion 120 to be extracted therefrom by a user.

Figure 12:
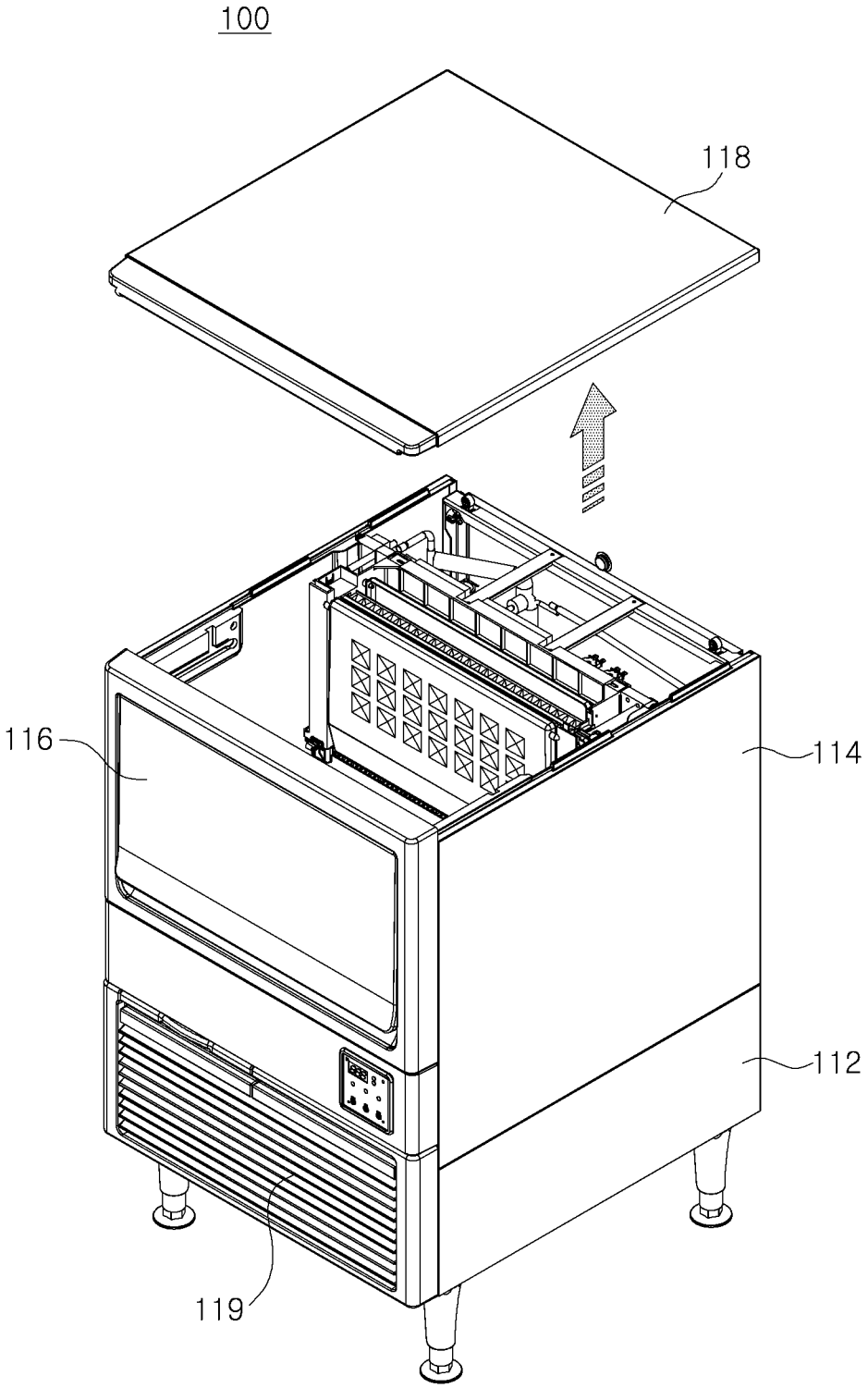
FIGS. 12 to 15 are perspective views illustrating a method of separating components of an ice maker according to an exemplary embodiment of the present disclosure.

In addition, according to an exemplary embodiment of the present disclosure, an upper cover 118 may be provided on an upper portion of the cabinet body 110 to be detachable therefrom as illustrated in FIG. 12.

In addition, in an exemplary embodiment of the present disclosure, the cabinet body 110 may include a lower cabinet 112 in which various electrical field components may be installed, and a separation cabinet 114 configured to cover the lower cabinet 112.

Figure 15:
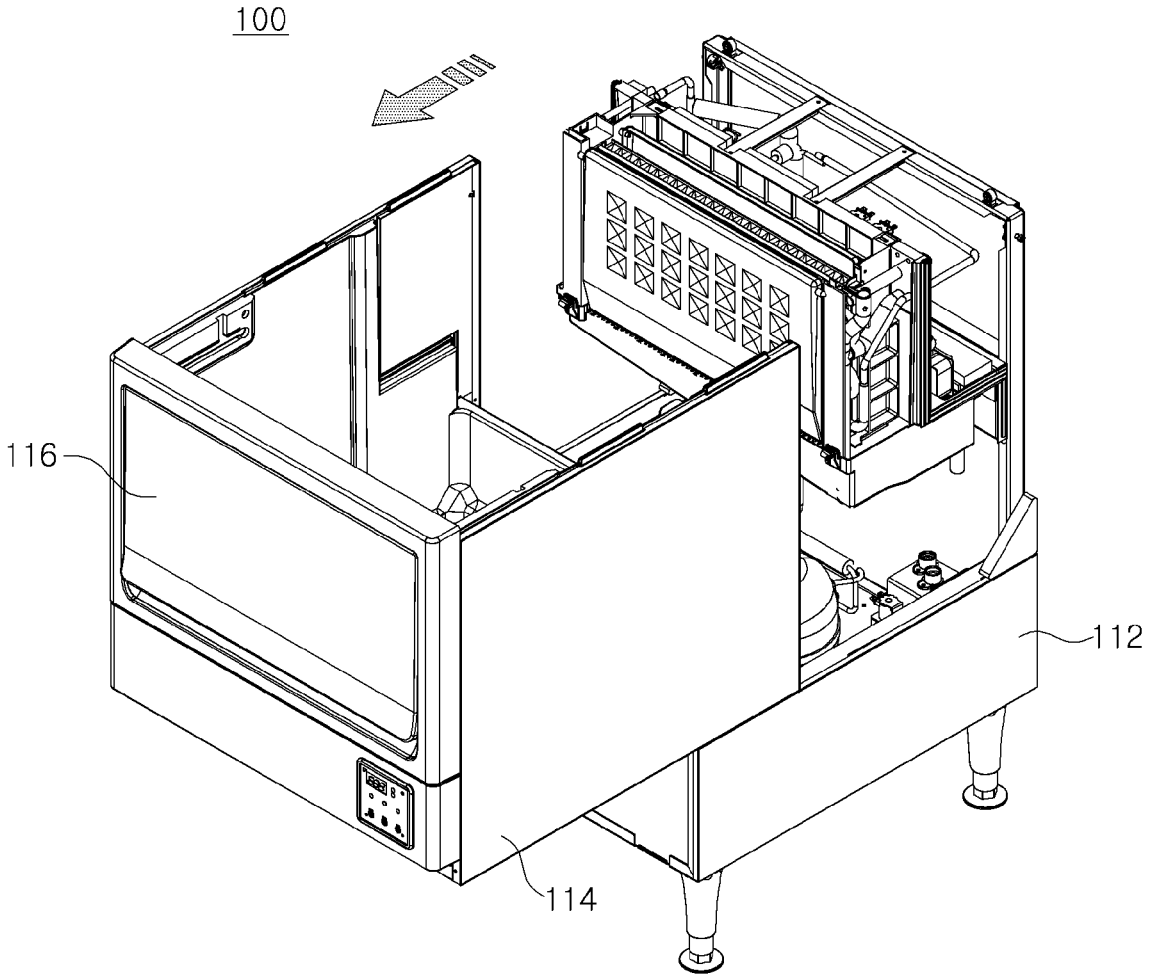

Here, the separation cabinet 114 may be configured to be separable from the lower cabinet 112 upwardly and forwardly thereof as illustrated in FIG. 15.

The ice storage portion 120 may be provided inside the cabinet body 110 and provided as a member having a box form in which ice generated in an ice making portion (not shown) may be stored.

In an exemplary embodiment of the present disclosure, the ice storage portion 120 may be configured to be fixed to the separation cabinet 114 and may be separated from the lower cabinet 112 according to a separation operation of the separation cabinet 114 as illustrated in FIG. 15.

However, exemplary embodiments of the present disclosure are not limited thereto, and thus, the ice storage portion 120 may also be configured as a separated-type portion so as to be separated from the cabinet body 110 independently thereof.

Figure 13:
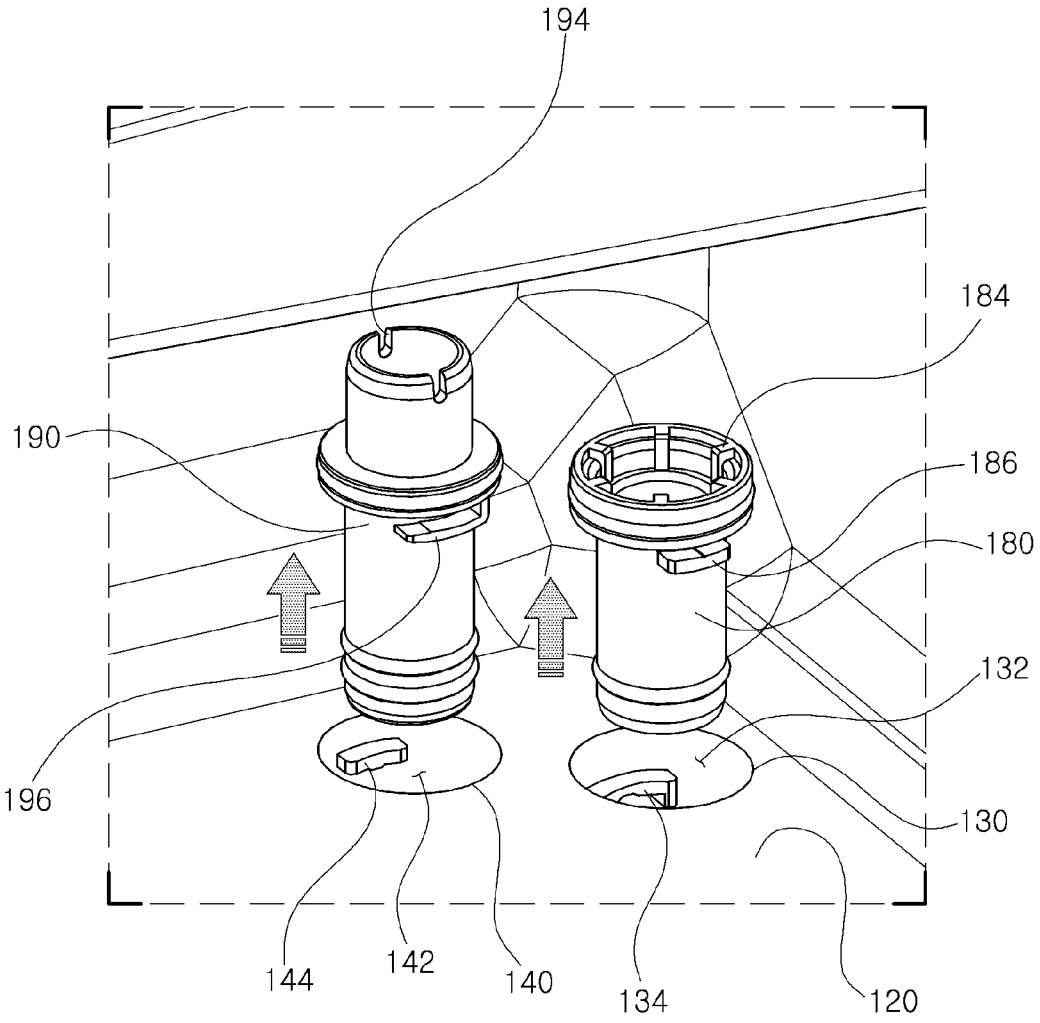

The first coupling portion 130 may be disposed on a lower surface of the ice storage portion 120 and include a first coupling hole 132 formed therein as illustrated in FIG. 13.

According to an exemplary embodiment of the present disclosure, the first coupling portion 130 may have a cylindrically-shaped structure protruding downwardly from the ice storage portion 120. Here, an internal aperture of the cylindrically-shaped structure may be provided as the first coupling hole 132.

In addition, in an exemplary embodiment of the present disclosure, the first coupling portion 130 may include a protrusion portion 134 protruding from an internal wall surface forming the first coupling hole 132.

The protrusion portion 134 may be caught by a stop protrusion 186 of the overflow socket 180, described below, to be coupled thereto.

In an exemplary embodiment of the present disclosure, the protrusion portion 134 may be extended to be horizontally elongated and a pair of protrusion portions 134 may be protruded so as to be symmetrical with respect to each other on opposing wall surface portions.

Figure 3:
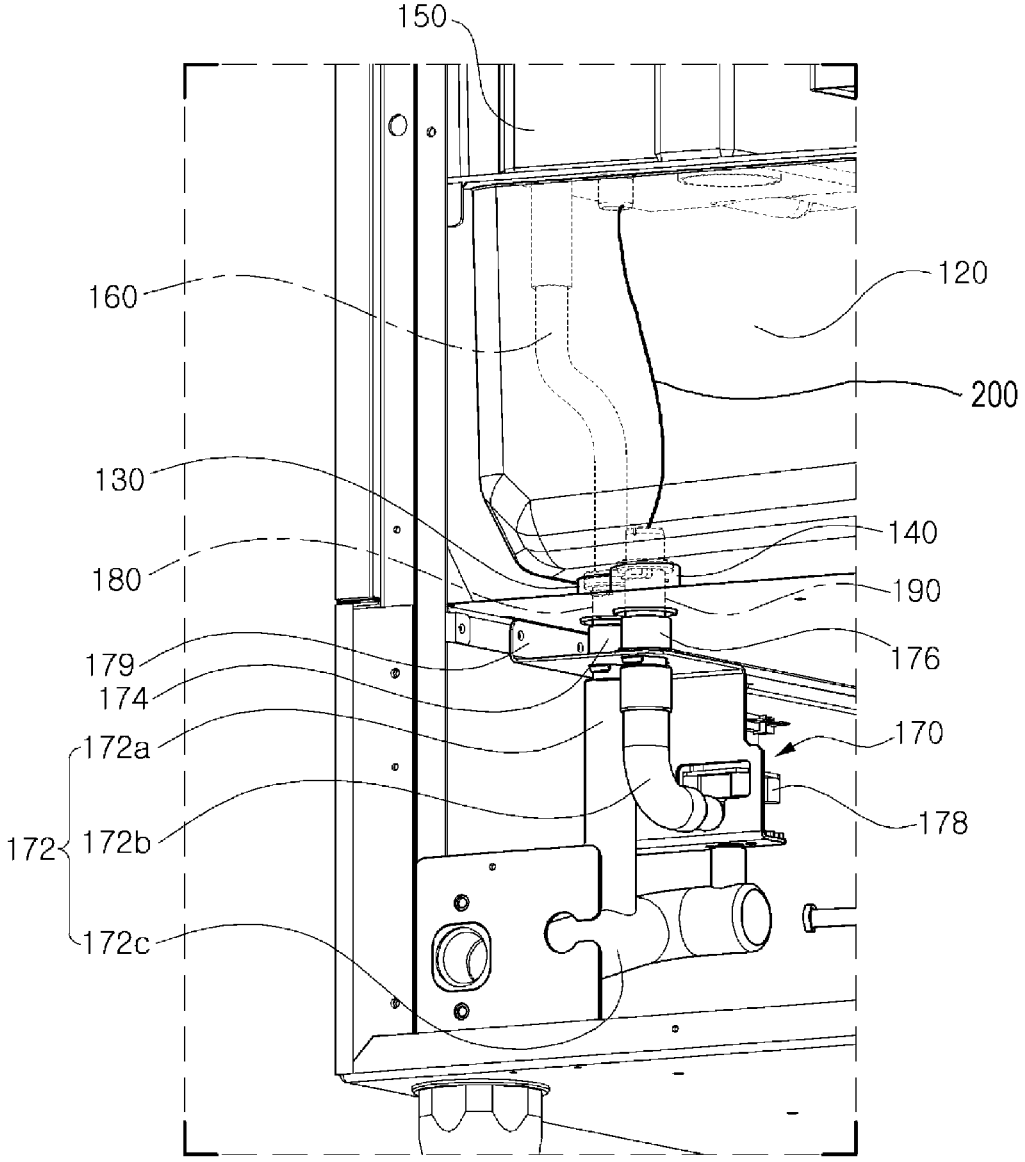
FIG. 3 is a rear perspective view illustrating a structure in which an ice storage portion, a water tank, a drain portion, the overflow socket, and the drain socket included in the ice maker of FIG. 1 are coupled to one another.
Figure 4:
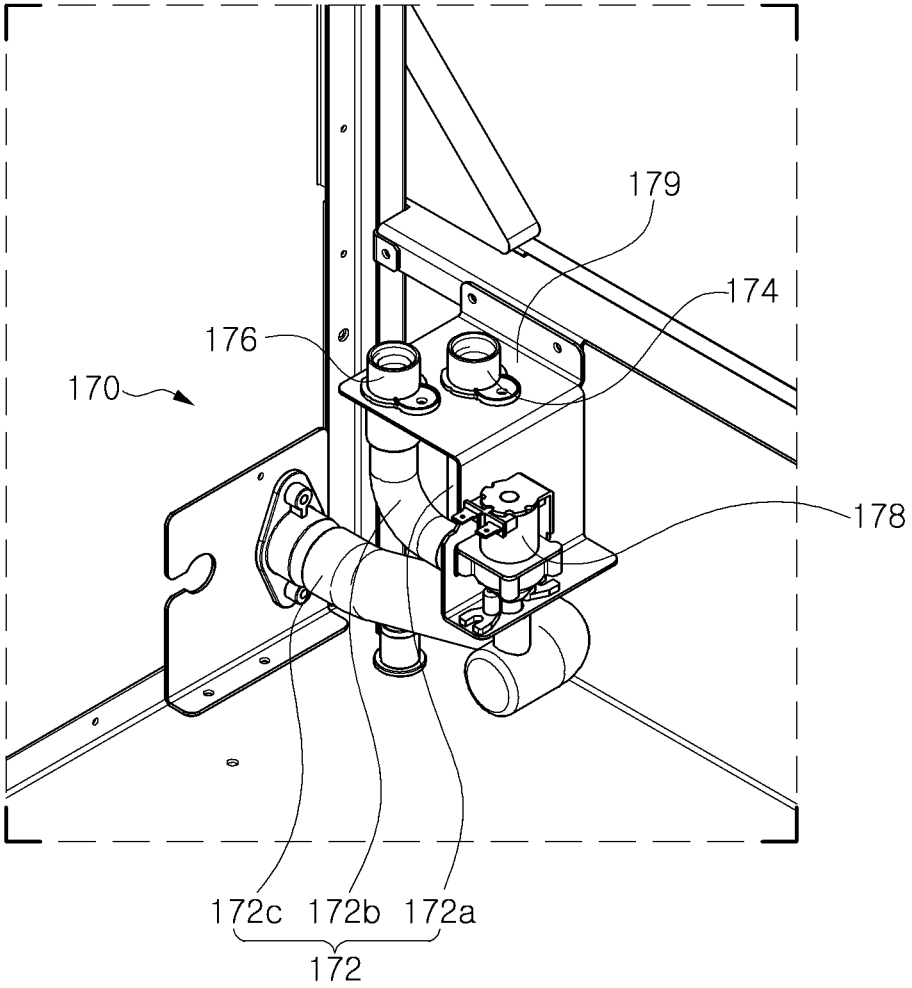
FIG. 4 is a perspective view of the drain portion.
Figure 5:
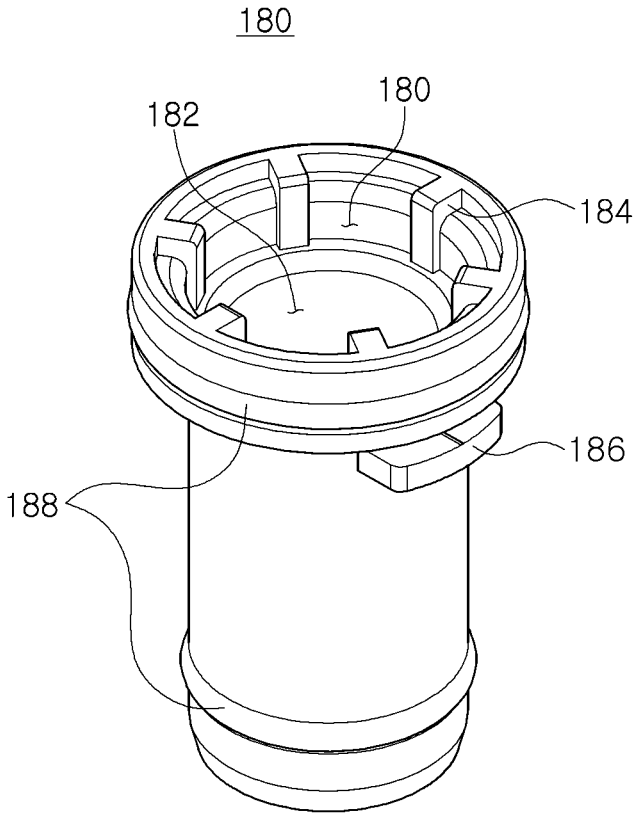
FIG. 5 is a perspective view of the overflow socket.
Figure 6:
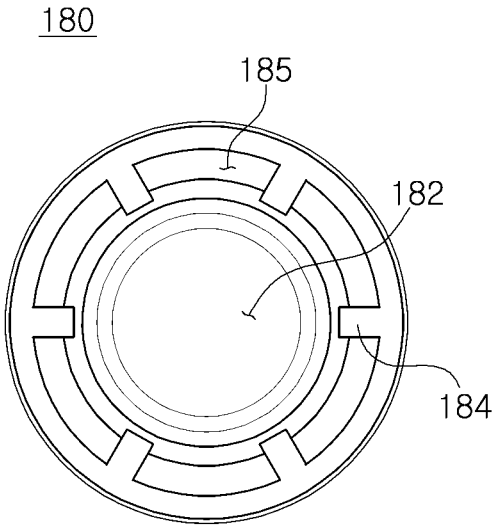
FIG. 6 is a plan view of the overflow socket.
Figure 7:
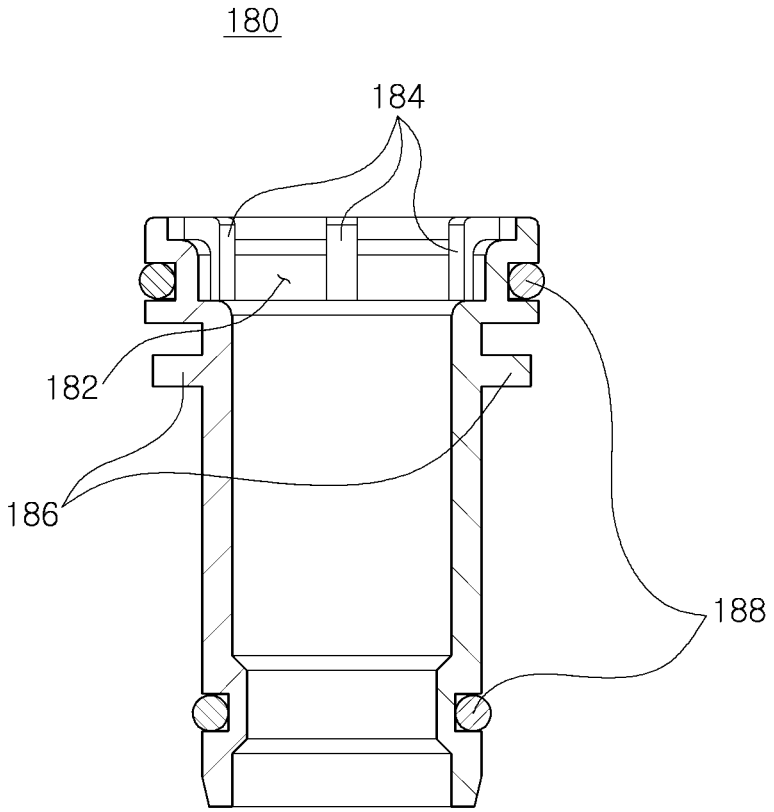
FIG. 7 is a side cross-sectional view of the overflow socket.
Figure 8:
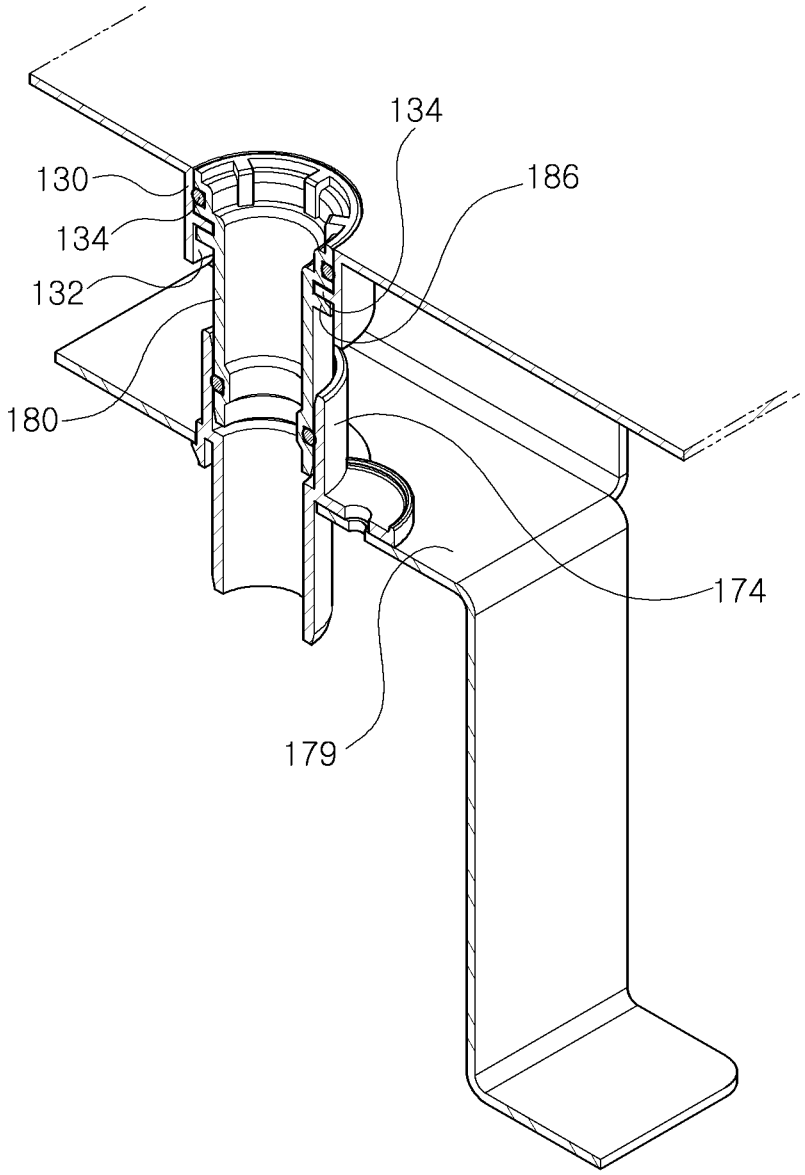
FIG. 8 is a cross-sectional perspective view illustrating a state in which the overflow socket, the ice storage portion and the drain portion are coupled to one another.
Figure 9:
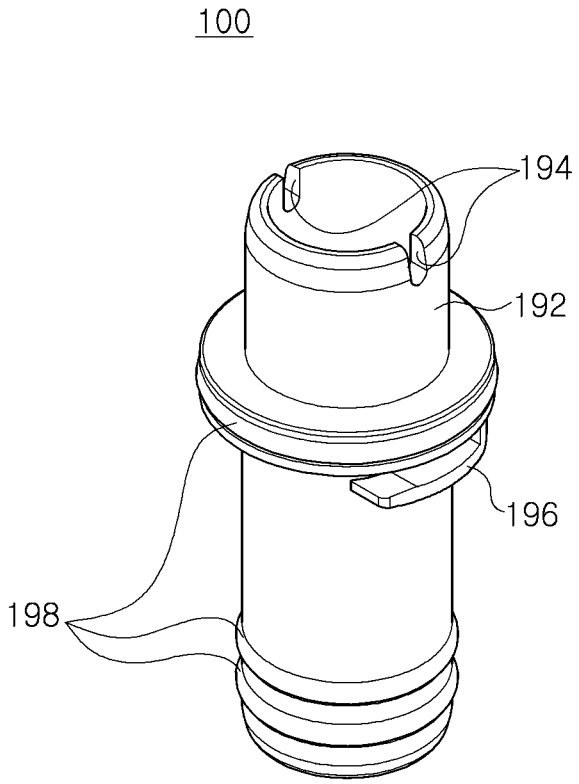
FIG. 9 is a perspective view of the drain socket.
Figure 10:
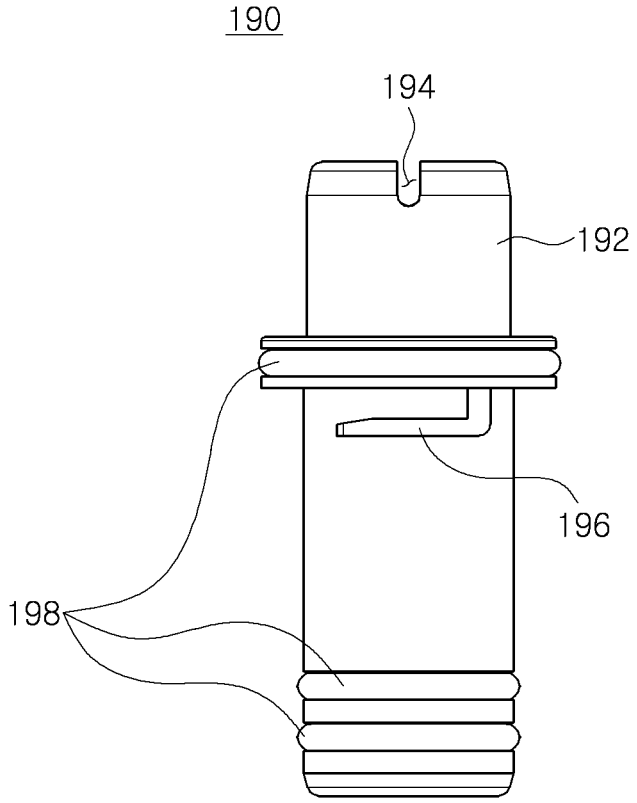
FIG. 10 is a side view of the drain socket.
Figure 11:
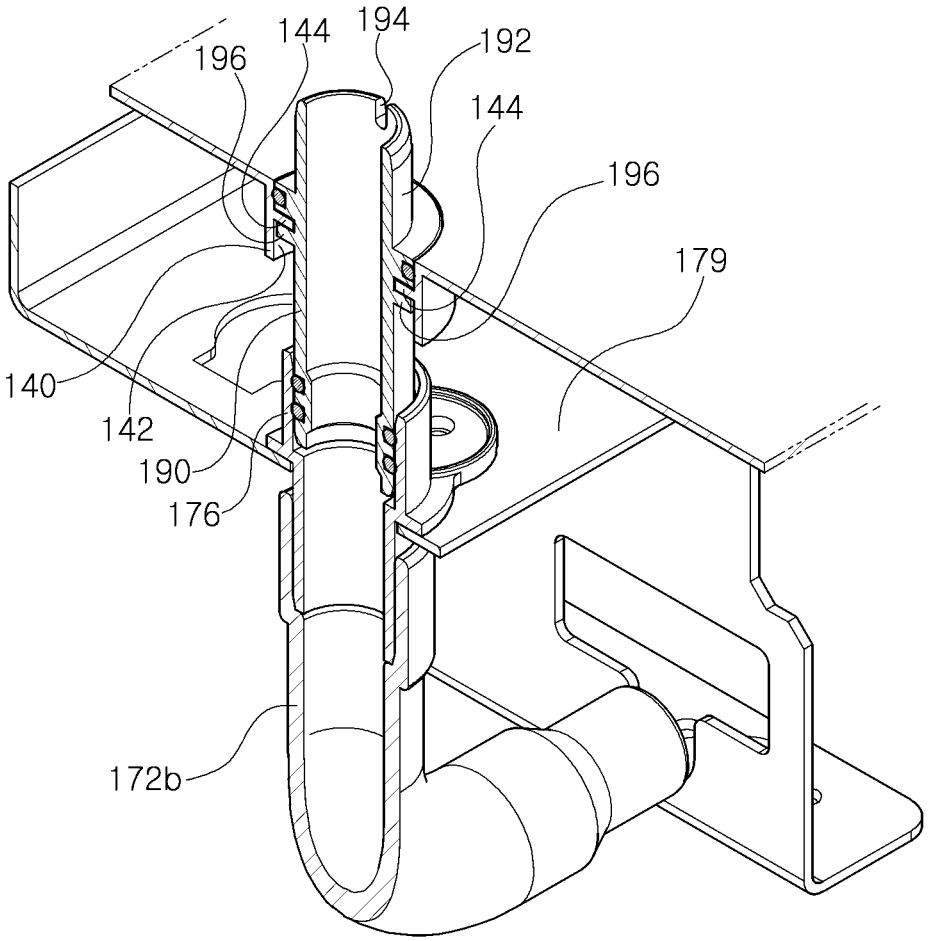
FIG. 11 is a cross-sectional perspective view illustrating a state in which the drain socket, the ice storage portion and the drain portion are coupled to one another.

On the other hand, according to an exemplary embodiment of the present disclosure, the first coupling portion 130 may be provided on a rear portion of the ice storage portion 120 to correspond to a position of the drain portion 170 described below as illustrated in FIG. 3.

As such, the structure in which the first coupling portion 130 is provided on the rear portion of the ice storage portion 120 may have positive attributes, in that a drainage passage 172 provided in the drain portion 170 described below may have a relatively short length.

However, a position of the first coupling portion 130 is not limited to the rear portion of the ice storage portion 120, and the first coupling portion 130 may be located in various positions on a bottom of the ice storage portion 120.

The second coupling portion 140 may be disposed on a lower surface of the ice storage portion 120 and may include a second coupling hole 142 as illustrated in FIG. 13.

In an exemplary embodiment of the present disclosure, the first coupling portion 130 may be provided as a cylindrically-shaped structure protruding downwardly from the ice storage portion 120. Here, an internal aperture of the cylindrically-shaped structure may be provided as the second coupling hole 142.

In addition, in an exemplary embodiment of the present disclosure, the second coupling portion 140 may include a protrusion plate 144 protruding from an internal wall surface forming the second coupling hole 142.

The protrusion plate 144 may be inserted into a hook portion 196 of a drain socket 190, described below, to be coupled thereto.

In an exemplary embodiment of the present disclosure, the protrusion plate 144 may be extended to be horizontally elongated and a pair of protrusion plates may be protruded so as to be symmetrical with respect to each other on opposing wall surface portions, but are not limited thereto.

On the other hand, according to an exemplary embodiment of the present disclosure, the second coupling portion 140 may be provided on a rear portion of the ice storage portion 120 to correspond to a position of the drain portion 170 described below as illustrated in FIG. 3.

As such, the structure in which the second coupling portion 140 is provided in the rear portion of the ice storage portion 120 may have positive attributes, in that the drainage passage 172 provided in the drain portion 170 to be described below may have a relatively short length.

However, a position of the second coupling portion 140 is not limited to the rear portion of the ice storage portion 120. The second coupling portion 140 may be located in various positions on a bottom of the ice storage portion 120.

The water tank 150 may be disposed upwardly of the ice storage portion 120 and ice making water may be stored therein.

Although not illustrated in the drawings, the water tank 150 may receive water supplied by an external water supply source.

The overflow pipe 160 may be provided in the water tank 150 and may configure a flow passage through which water having a level higher than a set water level in the water tank 150 may be discharged to the drain portion 170 to be described below, so that water may be prevented from overflowing from the water tank 150 in a case in which a water level of the water tank 150 exceeds the set water level.

Although not illustrated in the drawings, according to an exemplary embodiment of the present disclosure, the overflow pipe 160 may be configured as a pipe member vertically extended to have a height corresponding to a set water level inside the water tank 150.

In addition, the overflow pipe 160 may be disposed in an internal portion of the ice storage portion 120 and extended from a lower surface of the water tank 150 to a position of the overflow socket 180 to be described below as illustrated in FIG. 3.

In an exemplary embodiment of the present disclosure, a lower end of the overflow pipe 160 may be connected to the overflow socket 180 to be described below.

Further, in an exemplary embodiment of the present disclosure, a portion of the overflow pipe 160 connected from a lower surface of the water tank 150 to the overflow socket 180 may be configured so as to be independently separated from the water tank 150, but is not limited thereto.

The drain portion 170 may be provided in a downward portion of the ice storage portion 120 inside the cabinet body 110 and may be provided as a device to allow water discharged from the water tank 150 and the ice storage portion 120 to flow to an external drainage hole.

In an exemplary embodiment of the present disclosure, the drain portion 170 may include a drainage passage 172, an overflow connection portion 174, a drain connection portion 176, and a drain valve 178.

Here, the drainage passage 172 may be configured to include a first drainage passage 172*a*, a second drainage passage 172*b* and a connection passage 172*c*.

The first drainage passage 172*a* may be configured as a pipe member of which an upper end is disposed in a directly downward portion of the first coupling portion 130 to extend downwardly and may be connected to the connection passage 172*c* to be described below.

The drainage passage 172*a* may be connected to the overflow socket 180 described below.

The second drainage passage 172*b* may be configured as a pipe member of which an upper end is disposed in a directly downward portion of the first coupling portion 130 to extend downwardly and may be connected to the connection passage 172*c* to be described below.

The second drainage passage 172*b* may be connected to the drain socket 190 to be described below.

The connection passage 172*c* may be connected to the first drainage passage 172*a* and the second drainage passage 172*b* and a distal end thereof may be connected to an external drainage hole.

The connection passage 172*c* may be configured as a flow passage by which all of water flowing through the first drainage passage 172*a* and water flowing through the second drainage passage 172*b* is received and discharged to the external drainage hole.

The overflow connection portion 174 may be provided in an upper end of the first drainage passage 172*a* and provided as a socket type member into which a lower end portion of the overflow socket 180 to be described below may be inserted and coupled thereto.

According to an exemplary embodiment of the present disclosure, a bracket 179 fixing the overflow connection portion 174 and the drain connection portion 176 to each other may be provided in the lower cabinet 112.

The drain valve 178 may be provided on the second drainage passage 172*b* to open or close the second drainage passage 172*b*.

The drain valve 178 may close the second drainage passage 172*b* so as to allow ice making water to be stored in the water tank 150 while the ice making water is stored in the water tank 150 and an ice making operation thereof is performed. In addition, at the time of performing water discharge operations to remove the ice making water from the water tank 150, water stored in the water tank 150 may be discharged through the second drainage passage 172*b* and the connection passage 172*c* by opening the second discharge passage 172*b* by the drain valve 178.

When it is necessary for a user to discharge water stored in the water tank 150 in order to clean, maintain or repair the water tank 150, and exchange ice making water, the user may open the drain valve 178 to remove the water from the water tank 150.

The drain valve 178 may be configured as an electronic valve, but is not limited thereto.

The overflow socket 180 may be a member to couple the ice storage portion 120 and the drain portion 170 to each other while allowing the overflow pipe 160 and the first drainage passage 172*a* to be connected to each other.

In the case of the overflow socket 180, for example, when the ice storage portion 120 is installed inside the cabinet body 110, the overflow socket 180 may be inserted into the first coupling hole 132 of the first coupling portion 130 and a lower end portion thereof may be coupled to the overflow connection portion 174.

The overflow socket 180 may configure a flow path through which water flowing through the overflow pipe 160 flows to the first drainage passage 172*a* and a discharge path through which water received in the ice storage portion 120 is discharged to the first drainage passage 172*a*.

In an exemplary embodiment of the present disclosure, the overflow socket 180 may have a cylindrically-shaped body and include a connection hole 182, a gap formation protrusion 184, and a stop protrusion 186 formed on an upper end thereof.

The connection hole 182 may be formed in an upper end of the overflow socket 180 and may be configured to have an expanded pipe form so that an end portion of the overflow pipe 160 may be inserted thereinto.

The gap formation protrusion 184 may be formed along an internal circumferential surface of the connection hole 182 to protrude inwardly therefrom and thus form a drainage spacing 185 between an internal passage of the overflow socket 180 and the overflow pipe 160.

For example, the gap formation protrusion 184 may be formed along a circumferential surface of the connection hole 182 to perform a finger function of pressing and supporting the overflow pipe 160 and may form the drainage spacing 185 between the gap formation protrusions 184 adjacent to each other.

In such a structure, water generated in the ice storage portion 120 may flow to the internal passage of the overflow socket 180 through the drainage spacing 185 and may then be discharged through the first drainage passage 172*a*.

In this case, for example, when the overflow socket 180 is inserted into the first coupling hole 132 to be coupled thereto so that the water generated in the ice storage portion 120 may be smoothly discharged through the drainage spacing 185, a level of an upper end of the overflow socket 180 may be equal to or lower than a level of an internal bottom surface of the ice storage portion 120.

The stop protrusion 186 may be provided on an outer side surface of the overflow socket 180 and may be configured to be caught by the protrusion portion 134 provided on the first coupling portion 130.

According to an exemplary embodiment of the present disclosure, the stop protrusions 186 may be provided to be symmetrical with respect to each other on both side portions of the overflow socket 180 to correspond to the protrusion portions 134.

In such a configuration, the overflow socket 180 may be inserted into the first coupling hole 132 in a position in which the stop protrusion 186 and the protrusion portion 134 are located to deviate from each other to then be rotated, so that the stop protrusion 186 is caught by the protrusion portion 134 so as to be coupled to the ice storage portion 120.

In the opposite case, the overflow socket 180 may be rotated and disposed so that the stop protrusion 186 is separated from the protrusion portion 134, and may then escape from the first coupling hole 132.

For example, when the overflow socket 180 is coupled to the ice storage portion 120, an upper end portion of the overflow socket 180 may be coupled to the ice storage portion 120 and a lower end portion thereof may be coupled to the overflow connection portion 174 of the drain portion 170, so that the ice storage portion 120 may be coupled to the drain portion 170.

In addition, since the overflow socket 180 has a structure easily rotatable by allowing a separate member to be caught by the protruding gap formation protrusion 184, the coupling and separation thereof may be facilitated.

In addition, according to an exemplary embodiment of the present disclosure, the overflow socket 180 may further include packing members 188 to seal portions thereof contacting the first coupling hole 132 and the overflow connection portion 174.

The drain socket 190 may configure a path through which water stored in the water tank 150 is discharged to the second drainage passage 172*b* and may also be provided as a member connecting the ice storage portion 120 to the drain portion 170.

For example, when the ice storage portion 120 is installed inside the cabinet body 110, the drain socket 190 may be inserted into the second coupling hole 142 of the second coupling portion 140 and a lower end portion thereof may be coupled to the drain connection portion 176.

A hose member 200 guiding water from the water tank 150 to the drain socket 190 may be installed in the water tank 150 and the drain socket 190.

For example, the water tank 150 may have water remaining therein at a predetermined water level of water in which an impeller of a pump (not shown) may be submerged thereunder so as to prevent idling of the pump. In this case, in a case in which the water remaining in the water tank 150 leaves as it is for a long period of time, ice making water inside the water tank 150 may be contaminated. Thus, water received in the inside of the water tank 150 may be required to be automatically drained periodically.

To this end, according to an exemplary embodiment of the present disclosure, the hose member 200, the drain socket 190, and the second drainage passage 172*b* may configure a path through which water stored in the water tank 150 may be discharged.

In this case, the drain valve 178 may be automatically opened for a predetermined period of time during operating of the ice maker 100 according to an exemplary embodiment of the present disclosure so as to allow residual water in the water tank 150 to be drained.

On the other hand, according to an exemplary embodiment of the present disclosure, the drain socket 190 may have a cylindrically-shaped body and may be provided with a hose connection portion 192 disposed in an upper end thereof.

The hose connection portion 192 may be provided as a portion protruding upwardly from a bottom surface of the ice storage portion 120 and may be connected to the hose member 200.

In addition, in an exemplary embodiment of the present disclosure, the hose connection portion 192 may have a groove 194 formed therein.

The groove 194 may be formed by cutting a portion of an upper end of the hose connection portion 192 in a vertical direction.

The groove 194 may have a form in which a member may be caught thereby so as to facilitate the coupling and separation of the drain socket 190. For example, a user may easily rotate the drain socket 190 using a separate member that may be caught by the groove 194.

In an exemplary embodiment of the present disclosure, the groove 194 may be formed as a pair of grooves to be symmetrical with respect to each other in both side portions of the hose connection portion 192, but is not limited thereto.

In addition, according to an exemplary embodiment of the present disclosure, a hook portion 196 may be provided on an outer side surface of the drain socket 190.

The hook portion 196 may protrude from an outer side surface of the drain socket 190, so that the protrusion plate 144 of the second coupling portion 140 may be received and caught thereby or separated therefrom.

In an exemplary embodiment of the present disclosure, the hook portion 196 may be provided as hook portions disposed on both side portions of the drain socket 190 to be symmetrical with respect to each other and correspond to the protrusion plates 144.

In such a configuration, the drain socket 190 may be inserted into the second coupling hole 142 in a position in which the hook portions 196 and the protrusion plates 144 are located to deviate from each other, to then be rotated in a single direction, so that the protrusion plates 144 may be received by the hook portions 196 and be caught thereby and may thus be coupled to the ice storage portion 120.

Inversely, the drain socket 190 may be rotated in the other direction to be disposed so that the protrusion plates 144 are separated from the hook portions 196, and may then be escaped from the second coupling hole 142.

For example, when the drain socket 190 is coupled to the ice storage portion 120, an upper end portion of the drain socket 190 may be coupled to the ice storage portion 120 and a lower end portion thereof may be coupled to the drain connection portion 176 of the drain portion 170, thereby allowing the ice storage portion 120 to be coupled to the drain portion 170 via a cooperative operation of the overflow socket 180.

In addition, since the drain socket 190 has a structure to be easily rotated by allowing a separate member to be caught by the groove 194, the coupling and separation thereof may be facilitated.

In addition, according to an exemplary embodiment of the present disclosure, the drain socket 190 may further include packing members 198 to seal portions thereof contacting the second coupling hole 142 and the drain connection portion 176.

With reference to FIGS. 12 to 15, a method of separating components of an ice maker 100 according to an exemplary embodiment of the present disclosure will hereinafter be described.

First, as illustrated in FIG. 12, an upper cover 118 may be removed. When the upper cover 118 is removed, since the interior of the ice storage portion 120 is exposed, a user may take the overflow socket 180 and the drain socket 190 out of an upper portion of the cabinet body 110 or may also separate the overflow socket 180 and the drain socket 190 from the cabinet body 110 by opening the operating door 116.

After the upper cover 118 is removed and the overflow pipe 160 and the hose member 200 are separated from the overflow socket 180 and the drain socket 190, the overflow socket 180 and the drain socket 190 may be drawn out of the first coupling hole 132 and the second coupling hole 142, respectively, by rotating the overflow socket 180 and the drain socket 190, as illustrated in FIG. 13.

As such, when the overflow socket 180 and the drain socket 190 are separated, the ice storage portion 120 may be in a state in which the ice storage portion 120 may be separated from the drain portion 170.

Figure 14:
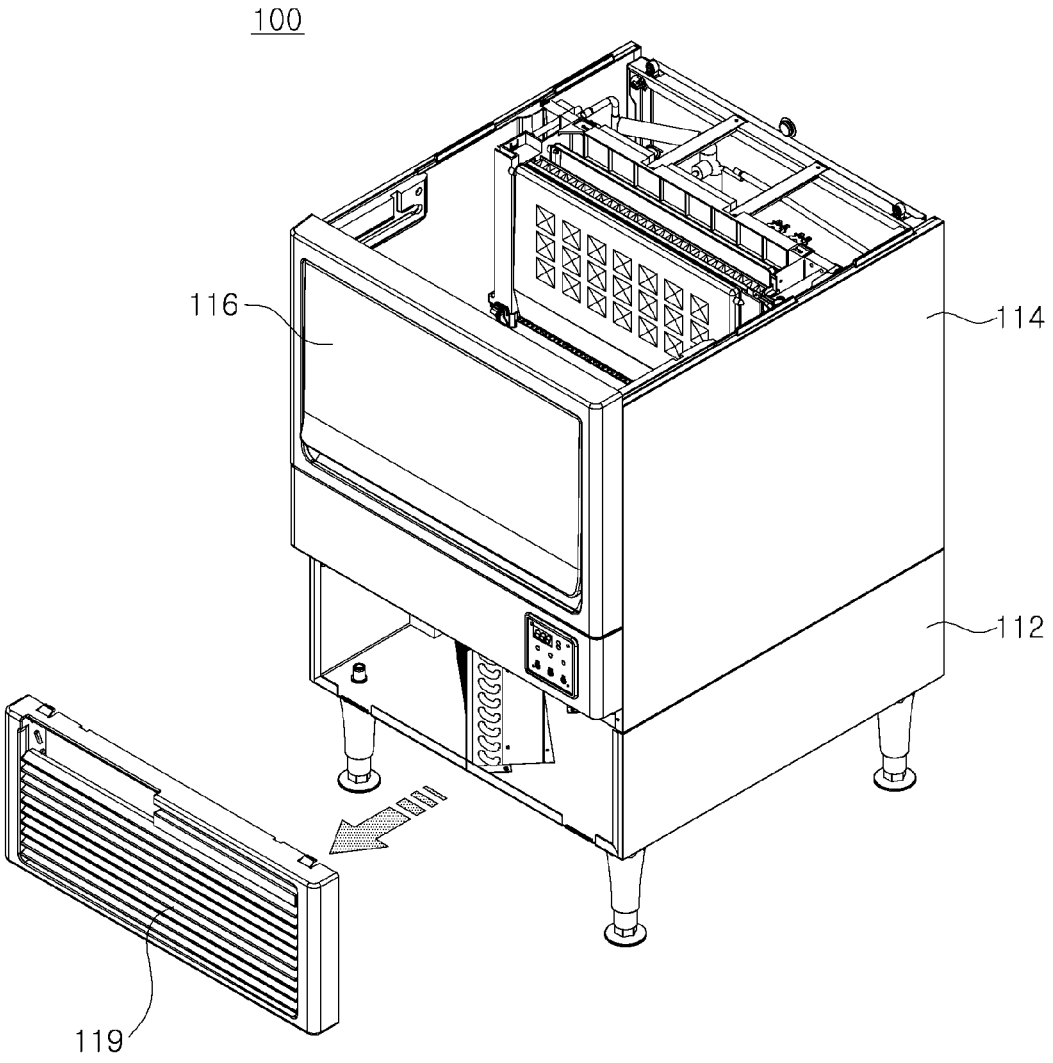

Next, as illustrated in FIG. 14, a front absorption portion 119 provided in a forward portion of the lower cabinet 112 may be separated from the lower cabinet 112.

In addition, as illustrated in FIG. 15, the separation cabinet 114 may be separated from the lower cabinet 112 to allow the interior of the ice maker 100 according to an exemplary embodiment of the present disclosure to be opened.

In this case, since the ice storage portion 120 is in the state in which the ice storage portion 120 is coupled to the separation cabinet 114 in the exemplary embodiment of the present disclosure, the ice storage portion 120, together with the separation cabinet 114, may be separated.

In the ice maker 100 according to an exemplary embodiment of the present disclosure, the drainage passage 172 of the water tank 150 and the ice storage portion 120 may be disposed in the rear of a device, the ice maker. Thus, the passages may be configured to have a relatively short length and be disposed in a substantially vertical direction, thereby preventing water from remaining in the drainage passage 172 and being contaminated.

In addition, in the ice maker 100 according to an exemplary embodiment of the present disclosure, a flow passage connected to the water tank 150 may be connected to the drainage passage 172 via the overflow socket 180 and the drain socket 190, and further, the ice storage portion 120 may be stably coupled to the cabinet body 110.

In addition, in the ice maker 100 according to an exemplary embodiment of the present disclosure, the coupling and separation of the overflow socket 180 and the drain socket 190 connecting the water discharge passage of the water tank 150 and the ice storage portion 120 and the drainage passage 172 to each other may be facilitated, thereby providing positive attributes such as relatively easy separation and coupling of devices.

As set forth above, according to exemplary embodiments of the present disclosure, separation and coupling of components included in a device may be facilitated.

In addition, according to exemplary embodiments of the present disclosure, since a structure in which water may not remain in the inside of a pipe may be obtained, sanitary properties of a device may be improved in the use thereof.

While embodiments have been shown and described above, it will be apparent to those skilled in the art that modifications and variations could be made without departing from the scope of the present disclosure as defined by the appended claims.

What is claimed is:

1. An ice maker comprising:

a cabinet body;

an ice storage portion provided in the cabinet body and separable from the cabinet body;

a first coupling portion disposed on a lower surface of the ice storage portion and having a first coupling hole;

a drain portion provided downwardly of the cabinet body within the cabinet body and including a drainage passage connected to an external drainage hole;

an overflow socket inserted into the first coupling hole and connected to the drainage passage to connect the ice storage portion to the drain portion, and configuring a path allowing water received by the ice storage portion to be discharged to the drainage passage;

a water tank disposed upwardly of the ice storage portion and storing ice making water therein;

a second coupling portion disposed on the lower surface of the ice storage portion and including a second coupling hole;

a drain socket inserted into the second coupling hole and coupled to the drainage passage to connect the ice storage portion and the drain portion to each other;

a hose member disposed between the water tank and the drain socket, for configuring a path through which water stored in the water tank is discharged to the drainage passage; and an overflow pipe provided in the water tank, wherein the overflow pipe is connected to the overflow socket, and wherein the overflow socket comprises:

a connection hole formed in an upper end portion of the overflow socket, the connection hole being provided such that an end portion of the overflow pipe is inserted therethrough; and a gap formation protrusion formed along an internal circumferential surface of the connection hole to protrude inwardly from the internal circumferential surface of the connection hole to form a drainage spacing between an internal passage and the overflow pipe.

2. The ice maker of claim 1, wherein the first coupling portion has a cylindrical shape protruding downwardly from the ice storage portion and includes a protrusion portion protruding from an internal wall surface forming the first coupling hole, and the overflow socket includes a stop protrusion provided on an outer side surface of the overflow socket and caught by the protrusion portion, the overflow socket being configured so that the stop protrusion is caught by the protrusion portion or separated from the protrusion portion via rotation of the overflow socket.

3. The ice maker of claim 1, wherein when the overflow socket is inserted into the first coupling hole to be coupled thereto, a level of an upper end of the overflow socket is equal to or lower than a level of an internal bottom surface of the ice storage portion.

4. The ice maker of claim 1, wherein the second coupling portion has a cylindrical shape protruding downwardly from the ice storage portion and includes a protrusion plate protruding from an internal wall surface forming the second coupling hole, and the drain socket includes a hook portion provided on an outer side surface of the drain socket and coupled to the protrusion plate, the drain socket being configured so that the protrusion plate is coupled to or separated from the hook portion via rotation of the drain socket.

5. The ice maker of claim 1, wherein the drain socket comprises a hose connection portion protruding upwardly from a bottom surface of the ice storage portion and a groove formed by cutting a portion of an upper end of the hose connection portion in a vertical direction.

6. The ice maker of claim 1, wherein the drainage passage comprises a first drainage passage connected to the overflow socket;

a second drainage passage connected to the drain socket; and a connection passage connected to the first drainage passage and the second drainage passage and having a distal end connected to an external drainage hole.

7. The ice maker of claim 6, wherein the drain portion comprises:

an overflow connection portion provided in an upper end of the first drainage passage and coupled to a lower end portion of the overflow socket; and a drain connection portion provided in an upper end of the second drainage passage and coupled to a lower end portion of the drain socket.

8. The ice maker of claim 6, wherein the drain portion further comprises a drain valve opening and closing the second drainage passage.

* * * * *